US008028364B2

(12) United States Patent
Jeong

(10) Patent No.: US 8,028,364 B2
(45) Date of Patent: Oct. 4, 2011

(54) COMMERCIAL WASHING MACHINE AND WASHING METHOD OF THE SAME

(75) Inventor: Ji An Jeong, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 862 days.

(21) Appl. No.: 12/036,863

(22) Filed: Feb. 25, 2008

(65) Prior Publication Data

US 2008/0201869 A1 Aug. 28, 2008

(30) Foreign Application Priority Data

Feb. 26, 2007 (KR) ..... 10-2007-0019036

(51) Int. Cl.
*D06F 33/02* (2006.01)

(52) U.S. Cl. ..... 8/158; 68/12.23

(58) Field of Classification Search ..... 68/12.02, 68/12.19, 12.23; 194/239, 241; 8/158, 159
See application file for complete search history.

(56) References Cited

U.S. PATENT DOCUMENTS 3,012,428 A * 12/1961 Cissell ..... 68/12.23
3,110,384 A * 11/1963 Rub ..... 194/217
4,493,410 A * 1/1985 Nelson ..... 194/241
5,585,704 A * 12/1996 Elzind ..... 318/446

* cited by examiner

*Primary Examiner* — Joseph L. Perrin
(74) *Attorney, Agent, or Firm* — Birch, Stewart, Kolasch & Birch, LLP

(57) ABSTRACT

A commercial washing machine that can be easily repaired and inspected and a washing method of the same are disclosed. The commercial washing machine includes a machine body for performing a predetermined washing cycle to laundry placed therein, a money depositing device mounted at one side of the machine body for allowing a user to deposit money therein, a control unit for controlling the washing cycle of the machine body, and a termination signal input device electrically connected to the control unit for allowing a signal for terminating the washing cycle in progress to be inputted thereto from the outside. The washing method includes detecting whether money has been deposited, performing a washing cycle including a washing operation, a rinsing operation, or a spin-drying operation according to the selection of a user, and terminating the washing cycle according to a termination signal inputted from the outside, irrespective of whether the remaining operations exist.

12 Claims, 3 Drawing Sheets

COMMERCIAL WASHING MACHINE AND WASHING METHOD OF THE SAME

CROSS-REFERENCE TO RELATED APPLICATION

This application claims the benefit of Korean Patent Application No. 10-2007-0019036, filed on Feb. 26, 2007, which is hereby incorporated by reference in its entirety as if fully set forth herein.

BACKGROUND OF THE INVENTION

1. Field of the Invention

The present invention relates to a washing machine, and more particularly, to a commercial washing machine that is capable of terminating a subsequent operation(s) of an overall washing cycle during a certain operation prior to the subsequent operation(s) and a washing method of the same.

2. Discussion of the Related Art

Generally, a laundry machine is a machine that cleans clothes and bedclothes (hereinafter, referred to as "laundry") through various processes, such as washing, rinsing, spin-drying, and drying, to remove contaminant from the laundry. Representative examples of the laundry machine include a washing machine and a drying machine.

Based on the purpose of use thereof, the washing machine may be classified as a household washing machine or as a commercial washing machine. The household washing machine is a general washing machine that is installed in a house to allow a user to do laundry using the washing machine without payment of laundry charges, whereas the commercial washing machine is a special washing machine that is installed in an apartment house or a place of business, such as a Laundromat, to require users who wish to do laundry using the washing machine to pay predetermined laundry charges and perform a washing operation for a predetermined period of time only when the payment of the predetermined laundry charges is completed.

As can be seen from the above description, the commercial washing machine is jointly used by an unspecified number of users, and therefore, the commercial washing machine is characterized in that the commercial washing machine is designed and manufactured such that the commercial washing machine exhibits higher profit efficiency, stability, and maintainability than the household washing machine.

Also, a commercial drying machine, which dries wet laundry using hot air and by mechanical actions, is generally used separately from the commercial washing machine, which washes, rinses, and spin-dries laundry using water and detergent and by mechanical actions to remove contaminant from the laundry.

In recent years, of course, a washing-and-drying machine, which is capable of washing, rinsing, spin-drying, and drying laundry in a batch fashion, has been placed on the market. However, the drying capacity of the washing-and-drying machine is less than the washing capacity of the washing-and-drying machine, the price of the washing-and-drying machine is relatively high, and the structure of the washing-and-drying machine is complicated, with the result that the commercial use of the washing-and-drying machine is not very popular.

For this reason, the commercial washing machine and the commercial drying machine are installed together at a place of a predetermined size. Preferably, a plurality of commercial washing machines and a plurality of commercial drying machines are installed to improve profit efficiency through the use of the commercial washing machines and the commercial drying machines by a plurality of users.

Generally, the commercial washing machine is constructed in a structure in which, when a user deposits money in the commercial washing machine, the commercial washing machine detects the deposit of the money through a reader mounted in the commercial washing machine and allows a user to manipulate the commercial washing machine.

According to the manipulation of the user, as shown in FIG. 1, the commercial washing machine performs a washing cycle including a washing operation (S2), a rinsing operation (S3), a spin-drying operation (S4), and a draining operation (S5).

Meanwhile, the commercial washing machine is continuously used by an unspecified number of users, with the result that there is a great possibility that the commercial washing machine will break or malfunction more frequently than the household washing machine. Consequently, an owner of the commercial washing machine inevitably has the commercial washing machine repaired frequently or inspected periodically.

However, when the commercial washing machine is operated to confirm whether the commercial washing machine malfunctions at a certain operation of an overall washing cycle during the repair or the inspection of the commercial washing machine, the operation of the commercial washing machine is stopped only after the remaining operations are performed even though the inspection of the certain operation is completed.

For example, when the commercial washing machine is operated to detect the abnormality of the rinsing operation, the operation of the commercial washing machine is stopped only after the remaining operations, i.e., the spin-drying operation and the draining operation, are performed even though the determination as to whether the rinsing operation is abnormal or not is completed.

Consequently, more than necessary time is required for repair and inspection of the commercial washing machine. Furthermore, for a Laundromat where a plurality of commercial washing machines are installed, the repair and inspection of the commercial washing machines are carried out for a long time, with the result that the owner of the Laundromat may suffer loss of profits. In addition, the increase of time necessary for the repair and inspection of commercial washing machines may incur user's inconvenience and distrust.

SUMMARY OF THE INVENTION

Accordingly, the present invention is directed to a commercial washing machine and a washing method of the same that substantially obviates one or more problems due to limitations and disadvantages of the related art.

An object of the present invention is to provide a commercial washing machine that is capable of arbitrarily terminating a certain washing process during the performance of an overall washing cycle, thereby reducing time necessary for the repair and inspection of the commercial washing machine.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing method of a commercial washing machine includes detecting whether money has been deposited, performing a washing cycle including a washing operation, a rinsing operation, or a spin-drying operation according to the selection of a user, and terminating the washing cycle according to a termination signal inputted from the outside, irrespective of whether the remaining operations exist.

In another aspect of the present invention, a commercial washing machine includes a machine body for performing a predetermined washing cycle to laundry placed therein, a money depositing device mounted at one side of the machine body for allowing a user to deposit money therein, a control unit for controlling the washing cycle of the machine body, and a termination signal input device electrically connected to the control unit for allowing a signal for terminating the washing cycle in progress to be inputted thereto from the outside.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Wherever possible, the same reference numbers will be used throughout the drawings to refer to the same or like parts.

Figure 1:
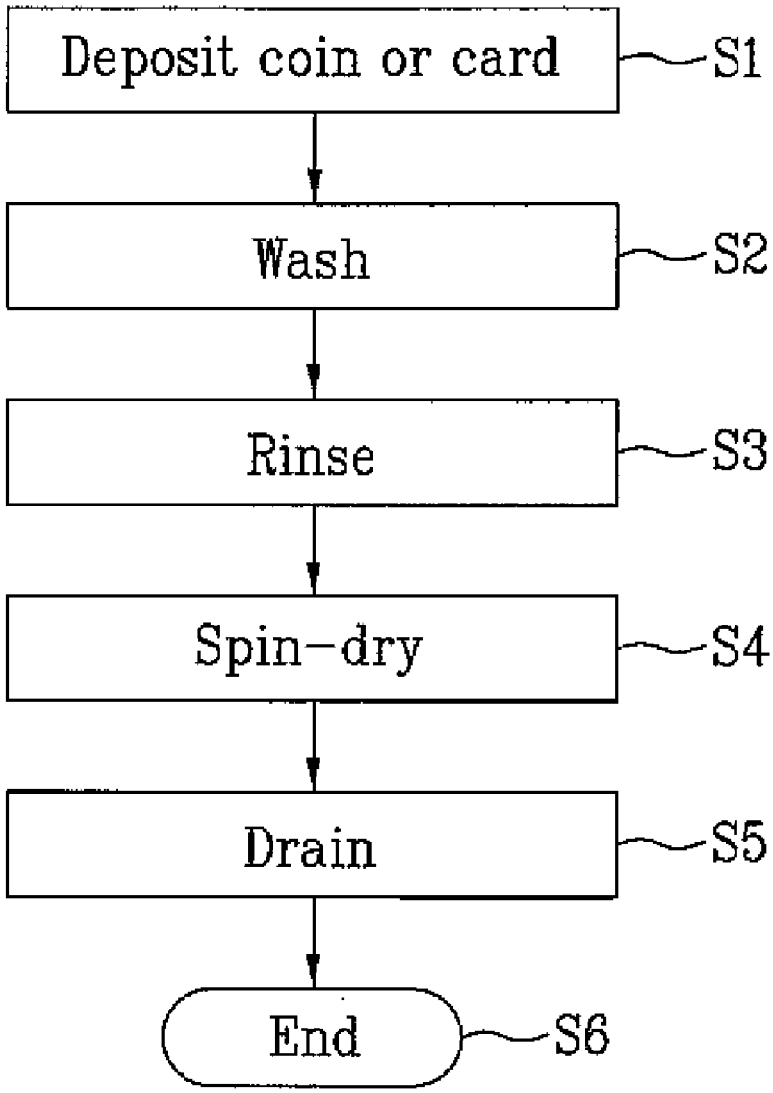
Fig. 1 Related Art
FIG. 1 is a block diagram illustrating a conventional washing process.
Figure 2:
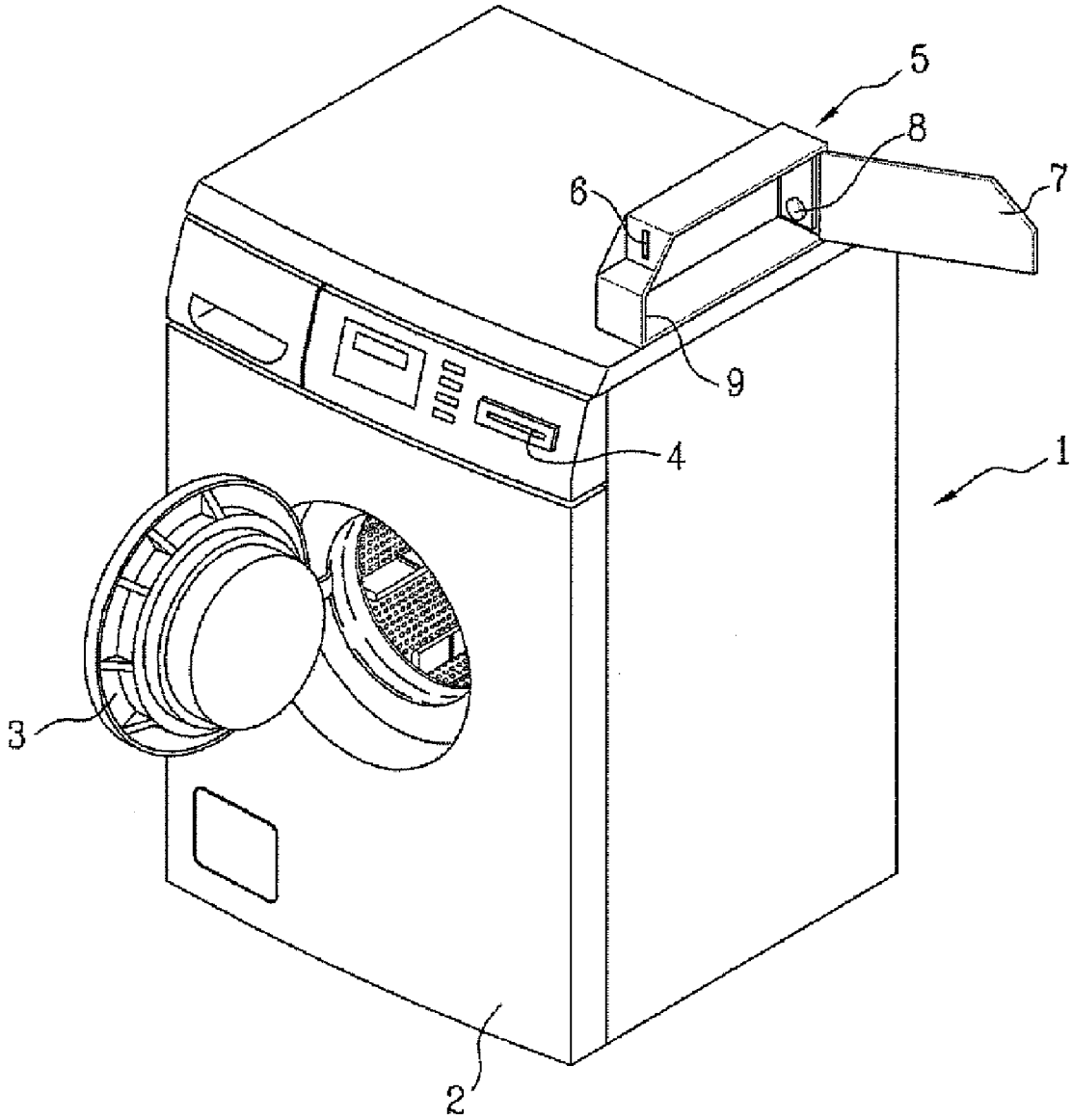
FIG. 2 is a perspective view schematically illustrating the external appearance of a commercial washing machine according to an embodiment of the present invention.
Figure 3:
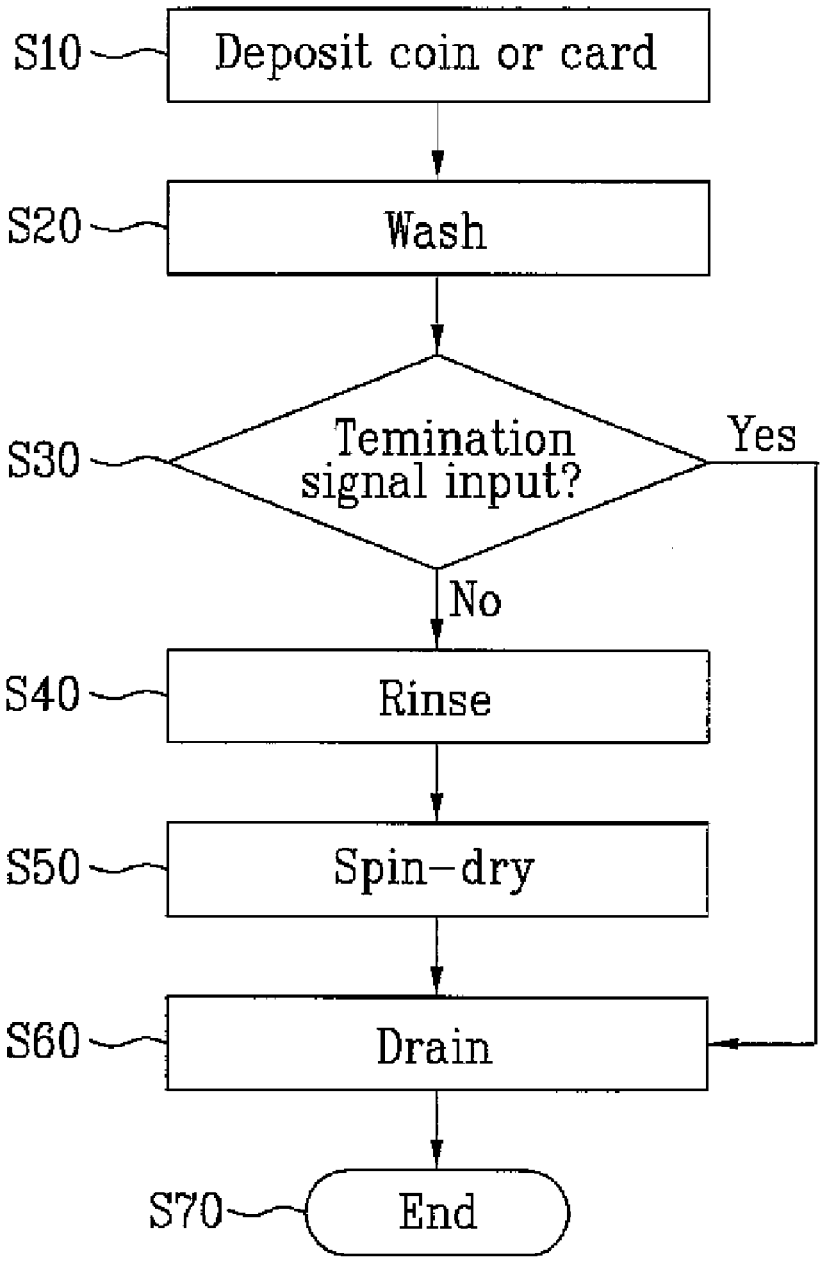
FIG. 3 is a flow chart illustrating a washing process with a cycle terminating function according to an embodiment of the present invention.

FIG. 2 is a perspective view schematically illustrating the external appearance of a commercial washing machine with a cycle terminating function according to an embodiment of the present invention, and FIG. 3 is a flow chart illustrating a washing process with a cycle terminating function according to an embodiment of the present invention.

First, the structure of the commercial washing machine according to the present invention will be described with reference to FIG. 2.

As shown in FIG. 2, the commercial washing machine according to the present invention includes a machine body 1 in which a washing operation is carried out. The machine body 1 includes a case 2 forming the external appearance of the machine body 1 and a door 3 mounted at the front of the case 2 for allowing laundry to be put into the machine body 1. Inside the machine body 1 is preferably formed a control unit (not shown) for controlling a washing cycle performed in the machine body 1.

At one side of the machine body 1 are mounted money depositing devices for requiring a user to deposit money necessary to use the commercial washing machine, such as a card slot 4 for allowing the user to deposit a card therein and a coin box 5 for allowing the user to deposit a coin.

At the front of the coin box 5 is formed a coin slot 6 through which a coin is deposited. Also, a coin detection unit (not show) is mounted at the front of the coin box 5 for detecting whether the coin has been deposited through the coin slot 6.

In addition, a coin box door 7 is mounted at one side of the coin box 5 for allowing the coins deposited in the coin box 5 to be easily withdrawn. Inside the coin box 5 is also mounted a circuit board (not shown) electrically connected to the control unit of the machine body 1.

Consequently, when a user deposits a coin into a coin slot 6, the coin detection unit detects that the coin has been deposited and transmits a predetermined signal informing that the coin has been deposited to the control unit of the machine body 1 through the circuit board. The control unit, having received the signal, sets the machine body 1 in a mode in which the user can manipulate the machine body 1 such that the machine body 1 performs an operation desired by the user.

On the other hand, when the user uses a card as another method of depositing money, whether the card has been deposited may be detected by a card reader (not shown) mounted adjacent to the card slot 4. Consequently, when the deposit of the card is detected by the card reader, the card reader transmits a signal informing that the card has been deposited to the control unit, and the control unit sets the machine body 1 in a mode in which the user can manipulate the machine body 1 such that the machine body 1 performs an operation desired by the user.

In this embodiment, both the card slot 4 and the coin box 5 are mounted at the machine body 1. However, the present invention is not limited to this embodiment. For example, either the card slot 4 or the coin box 5 may be mounted at the machine body 1.

As shown in FIG. 2, the coin box 4 may be provided separately from the machine body 1. In this case, the coin box 4 is detachably attached to the machine body 1, and therefore, the withdrawal of the deposited coins is very easy. However, this structure is an example that may be conceived according to the present invention. For example, therefore, the coin box 5, having the coin slot 6, may be integrally mounted to the machine body 1.

The commercial washing machine according to the present invention preferably includes a termination signal input device to which a signal for immediately terminating the washing cycle is inputted.

As previously described, the commercial washing machine is continuously used by an unspecified number of users, with the result that there is a great possibility that the commercial washing machine will break or malfunction more frequently than the household washing machine, and therefore, the commercial washing machine may be frequently inspected and repaired.

When the washing cycle is carried out to detect whether a certain operation of the washing cycle is abnormal, time necessary for the repair and inspection of the commercial washing machine may excessively increase if the remaining operations must be subsequently carried out even after the certain operation has been carried out and the detection whether the certain operation is abnormal has been carried out.

For this reason, the termination signal input device is preferably provided to allow the input of a signal for immediately terminating the washing cycle, without the performance of the remaining operations, after the certain operation needed to be inspected is carried out. In this case, it is possible to terminate the washing cycle, after detection as to whether the certain operation is abnormal, without the further performance of the unnecessary remaining operations, whereby it is possible to reduce time necessary for the repair and inspection of the commercial washing machine.

The termination signal input device is electrically connected to the control unit of the machine body 1 such that the termination signal input device receives a signal for terminating the washing cycle from the outside and transmits the signal to the control unit. Consequently, when the signal is inputted to the termination signal input device, the termination signal input device transmits the signal to the control unit such that the washing cycle is forcibly terminated.

When the signal is transmitted from the termination signal input device to the control unit, a washing mode corresponding to an urgent termination operation is adopted first of all, and therefore, the washing cycle is terminated. That is, when the signal is transmitted to the control unit, the operation in progress is forcibly terminated, a draining operation is immediately carried out to drain wash water received in the machine body 1 out of the machine body 1, irrespective of whether the remaining operations exist, and then the washing cycle is terminated.

Meanwhile, it is obvious that the termination signal input device is different in construction from a power switch for turning power supplied to the washing machine on or off. The power switch is constructed to intercept the power supplied to the washing machine to stop the operation of the washing machine, whereas the termination signal input device is constructed to output a new control signal such that the urgent termination operation is carried out in the washing cycle in progress.

Consequently, even when the washing cycle is terminated by the termination signal input device, the power is continuously supplied to the machine body 1, and therefore, the machine body 1 is ready to return to its initial stage where a new washing cycle can be commenced.

In this embodiment, the termination signal input device is a cycle termination switch 8 disposed to allow a user's direct manipulation.

In this case, as shown in FIG. 2, the cycle termination switch 8 is preferably located at a position not exposed to the outside such that the access to the cycle termination switch 8 from the outside is difficult. This is because, if the cycle termination switch 8 is located such that the cycle termination switch 8 is exposed to the outside, other users may forcibly terminate the washing cycle whether it is intentional or unintentional. In particular, the cycle termination switch 8 is mainly used at the time of repairing and inspecting the washing machine. Consequently, it is preferred for the cycle termination switch 8 to be mounted at a position where only a person who manages the washing machine can access, for example, inside the coin box 5.

In this embodiment, therefore, it is preferred that the coin box door 7 is mounted at one side of the coin box 5 in such a manner that the coin box door 7 can be opened and closed, and the cycle termination switch 8 is mounted inside the coin box 5 such that the cycle termination switch 8 can be accessed only when the coin box door 7 is opened.

The coin box door 7 is preferably locked by a locking device such that the coin box door 7 can be opened only when the withdrawal of the coins deposited in the coin box 5 is needed or the repair and inspection of the coin body 5 are required. In this case, only an authorized manager can access the cycle termination switch 8.

In this embodiment, an opening and closing detection unit 9 is preferably mounted at a position adjacent to the coin box door 7 for detecting whether the coin box door 7 is open or closed. The opening and closing detection unit 9 is connected to a circuit board mounted inside the coin box 5. Consequently, it is possible for the opening and closing detection unit 9 to detect whether the coin box door 7 is open or closed and transmits a signal corresponding to the detection to the control unit.

When the coin box door 7 is opened during the progress of the washing cycle, there is a great possibility that the repair and inspection of the washing machine are being carried out. Consequently, when the opening of the coin box door 7 is detected by the opening and closing detection unit 9 during the progress of the washing cycle, it is preferred to perform a controlling operation such that the washing cycle in progress is temporarily interrupted.

According to the present invention, therefore, the washing cycle is temporarily interrupted when the coin box door 7 is opened during the progress of the washing cycle. And when the cycle termination switch 8 inside the coin box 4 is pressed, the washing cycle is terminated irrespective of whether the remaining operations exist. However, when the coin box door 7 is closed without the cycle termination switch 8 being pressed, it is preferred for the opening and closing detection unit 9 to detect the closing of the coin box door 7 and to resume the washing cycle, which is being temporarily interrupted.

In this embodiment, as previously described, the cycle termination switch 8 is provided to which a signal corresponding to the urgent termination of the washing cycle is inputted during the repair and inspection of the commercial washing machine. However, it is also possible to conceive another embodiment that allows the same signal to be inputted thereto.

For a commercial washing machine including a card reader for detecting whether a card has been inserted into the card slot 4 as in this embodiment, for example, it is possible to construct the washing machine in a structure in which, when another card for terminating the washing cycle is inserted, the insertion of the card is detected, and a control signal for terminating the washing cycle is generated.

The card for terminating the washing cycle is different from cards carried by users to pay charges. That is, the card for terminating the washing cycle is an exclusive card carried by the manager of the washing machine to repair and inspect the washing machine. This construction has an advantage in that the process for releasing the locking device of the coin box 5 is omitted, and therefore, it is possible to easily and simply terminate the washing cycle.

Hereinafter, a washing method of the commercial washing machine with the above-stated construction according to the present invention will be described.

First, a money deposit detecting step is carried out to detect whether a user has paid charges using a coin or a card. The money deposit detecting step is preferably carried out before the commencement of a washing cycle of a commercial washing machine, which performs the washing cycle only after the user has deposited money.

However, not when the user generally uses the washing machine but when the washing machine is operated by a manager of the washing machine to repair and inspect the washing machine, it is possible to detect whether the money has been deposited using another method replacing the deposit of the coin or the card.

For example, when the deposit of a master card carried by only the manager is detected at the money deposit detecting step or when the release of the locking device of the coin box door 7 that only the manager can access is detected, it may be determined that the money has been deposited.

When the deposit of the money is detected at the money deposit detecting step, a washing cycle is carried out according to the manipulation of the user.

As an example, the washing cycle generally includes a washing operation, a rinsing operation, a spin-drying operation, and a draining operation, which are sequentially carried out. However, it is possible to configure the washing cycle such that the sequence of the operations in the washing cycle is changed or the washing cycle includes other operations.

Consequently, when the abnormality of a certain operation is required to be detected during the repair or inspection of the washing machine, it is possible to manipulate the contents of the washing cycle such that the certain operation can be reached in the shortest time.

According to the present invention, on the other hand, a cycle terminating step may be carried out to terminate the washing cycle according to a termination signal inputted from the outside during the performance of the washing cycle, irrespective of whether the remaining operations exist.

When the washing cycle is carried out to detect whether the certain operation is abnormal during the repair or inspection of the washing machine, as previously described, it is possible to immediately terminate the washing cycle, without the performance of the remaining operations, after the certain operation is carried out.

When a signal for terminating the washing cycle is inputted from the outside, the operation in progress is terminated, wash water received in the washing machine is drained, and the washing cycle is terminated at the cycle terminating step.

Of course, when a signal for terminating the washing cycle is not inputted from the outside, it is obvious that the cycle terminating step is not carried out, but the washing machine is operated according to the washing cycle, and then the operation of the washing machine is stopped.

Hereinafter, a control method of the commercial washing machine according to an embodiment of the present invention will be described in detail with reference to FIG. 3.

First, a money deposit detecting step (S10) is carried out to determine whether money, such as a coin or a card, has been deposited to use the commercial washing machine.

When it is detected that the money has been deposited, a washing cycle is carried out according to the manipulation of a user. Although the washing cycle may be changed depending upon the setting by the user, as shown in FIG. 3, the washing cycle is preferably carried out such that a washing operation (S20), a rinsing operation (S40), a spin-drying operation (S50), and a draining operation (S60) are sequentially carried out.

On the other hand, when the washing cycle is carried out to detect the abnormality of the washing operation during the repair and inspection of the washing machine, as shown in FIG. 3, a washing cycle terminating step (S30) may be carried out, if necessary, after the completion of the washing operation.

Consequently, when a signal for terminating the washing cycle is inputted from the outside after the completion of the washing operation (S20), the wash water may be drained out of the washing machine (S60), without the performance of the remaining operations, i.e., the rinsing operation (S40) and the spin-drying operation (S50), and then the washing cycle may be terminated (S70).

Of course, when a signal for terminating the washing cycle is not inputted from the outside after the completion of the washing operation (S20), and therefore, the washing cycle terminating step (S30) is not carried out, the rinsing operation (S40), the spin-drying operation (S50), and the draining operation (S60) are sequentially carried out, and then the washing cycle is terminated (S70).

According to the present invention as described above, the washing cycle is terminated after only a certain step at which the inspection and repair of the washing machine are required is checked. As a result, it is possible to inspect and repair the washing machine in a shorter time. Consequently, it is possible to prevent loss of profits and inconvenience of users due to the inspection and repair of the washing machine for a long time.

Of course, the construction for terminating the washing cycle may be applied to a household washing machine in addition to the commercial washing machine.

As apparent from the above description, the commercial washing machine according to the present invention can terminate the washing cycle after it has been determined whether a certain operation is abnormal during the repair and inspection of the washing machine, without the performance of the unnecessary remaining operations. Consequently, the present invention has the effect of reducing time necessary to repair and inspect the washing machine, thereby preventing loss of profits due to the failure to commercially use the washing machine and preventing inconvenience of users due to the inspection and repair of the washing machine for a long time.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A commercial washing machine comprising:

a machine body for performing a predetermined washing cycle to laundry placed therein;

a money depositing device mounted to the machine body for allowing a user to deposit money therein;

a control unit for controlling the washing cycle of the machine body; and a termination signal input device electrically connected to the control unit for allowing a signal for terminating the washing cycle in progress to be inputted thereto from the outside, wherein the termination signal input device is disposed within the money depositing device so as not to be directly exposed to the user.

2. The commercial washing machine according to claim 1, wherein, when the signal is transmitted from the termination signal input device to the control unit, the control unit controls wash water in the machine body to be drained and the washing cycle to be terminated while maintaining the power of the machine body on.

3. The commercial washing machine according to claim 1, wherein the termination signal input device includes a cycle termination switch disposed to allow a user's direct manipulation.

4. The commercial washing machine according to claim 3, wherein the money depositing device includes a coin box having a coin slot formed at an outer surface thereof, and the cycle termination switch is mounted at an inside of the coin box.

5. The commercial washing machine according to claim 4, wherein the coin box is provided at one side thereof with a coin box door in such a manner that the coin box door can be opened and closed, and the cycle termination switch is located such that the cycle termination switch can be manipulated after the coin box door is opened.

6. The commercial washing machine according to claim 5, further comprising:

an opening and closing detection unit mounted at the inside of the coin box for detecting whether the coin box door is open or closed.

7. A commercial washing machine comprising:

a machine body for performing a predetermined washing cycle to laundry placed therein;

a money depositing device mounted to the machine body for allowing a user to deposit money therein;

a control unit for controlling the washing cycle of the machine body; and a termination signal input device electrically connected to the control unit for allowing a signal for terminating the washing cycle in progress to be inputted thereto from the outside, wherein the money depositing device includes a card slot for allowing the user to insert a card therein, and the termination signal input device includes a card reader mounted adjacent to the card slot for detecting whether a card configured to generate the signal for terminating the washing cycle has been inserted in the card slot.

8. A controlling method of a commercial washing machine, comprising:

detecting whether money has been deposited in a money depositing device;

performing a washing cycle including a washing operation, a rinsing operation, or a spin-drying operation according to the selection of a user; and terminating the washing cycle by a control unit according to a termination signal inputted from the outside, irrespective of whether the remaining operations exist, wherein terminating the washing cycle includes:

operating a termination signal input device, the termination signal input device disposed within the money depositing device so as not to be directly exposed to the user; and inputting the termination signal from the termination signal input device to the control unit.

9. The controlling method according to claim 8, wherein terminating the washing cycle includes draining wash water received in the washing machine outwardly and terminating the washing cycle.

10. The controlling method according to claim 8, wherein terminating the washing cycle is carried out while power is continuously supplied to the washing machine.

11. The controlling method according to claim 8, wherein the money depositing device includes a coin box having a coin slot through which the money is deposited in the coin box, and the terminal signal input device includes a cycle termination switch installed in the coin box, and wherein operating the termination signal device includes a cycle termination switch installed in the coin box.

12. A controlling method of a commercial washing machine, comprising:

detecting whether money has been deposited in a money depositing device;

performing a washing cycle including a washing operation, a rinsing operation, or a spin-drying operation according to the selection of a user; and terminating the washing cycle by a control unit according to a termination signal inputted from the outside, irrespective of whether the remaining operations exist, wherein terminating the washing cycle includes:

inserting a card configured to generate the termination signal into a slot provided at the commercial washing machine, and inputting the termination signal by the card to the control unit.

* * * * *